United States Patent [19]

Hesler et al.

[11] 3,939,611

[45] Feb. 24, 1976

[54] WORKPIECE FEEDING APPARATUS, ESPECIALLY FOR MACHINING EQUIPMENT

[75] Inventors: Dietrich Hesler, Frickenhausen; Gerhard Gresser, Oberboihingen; Helmut Brandstetter, Nuertingen, all of Germany

[73] Assignee: Karl M. Reich Maschinenfabrik GmbH, Nuertingen, Germany

[22] Filed: Mar. 11, 1974

[21] Appl. No.: 450,228

[30] Foreign Application Priority Data

Mar. 28, 1973 Germany ..... 2315389

[52] U.S. Cl. ..... 51/139; 51/141

[51] Int. Cl.[2] ..... B24B 21/06

[58] Field of Search ..... 51/135–148, 51/165

[56] References Cited

UNITED STATES PATENTS 3,271,909 9/1966 Ratt et al. ..... 51/138

FOREIGN PATENTS OR APPLICATIONS 1,148,465 5/1963 Germany ..... 51/141

*Primary Examiner*—Othell M. Simpson

*Attorney, Agent, or Firm*—Wolfgang G. Fasse; Willard W. Roberts

[57] ABSTRACT

Apparatus for feeding workpieces through a machine employing a workpiece guide and at least one sensor for determining the dimensions of the workpiece. The workpiece guide applies pressure to the workpiece in accordance with the dimensions of the workpiece as determined by the sensor which includes one or more vertical or arcuate sensing members contacting the workpieces and moving in accordance with the dimensions thereof. Switches for controlling a driving motor of the workpiece guide are actuated by control cams responsive to the movements of the sensor.

14 Claims, 10 Drawing Figures

WORKPIECE FEEDING APPARATUS, ESPECIALLY FOR MACHINING EQUIPMENT

BACKGROUND OF THE INVENTION

The invention relates to a workpiece feeding apparatus, especially for machining equipment in a continuous operation by moving a workpiece through a feeding channel which includes adjustably supported workpiece guide means.

Large machines for production working of the surfaces of wood and wood material boards, veneered panels, polyester varnish coatings, felt and foam rubber workpieces, metals, and cast or natural stone slabs are well-known. The workpiece moves or is moved on conveying means through these machines whereby guide means such as pressure feed rollers press on the top surface of the workpiece while its downwardly facing surface is being worked as is the case, for example, in conventional so called bottom sanding machines, especially of the wide belt type. If the workpiece is being worked on its top surface pressure is applied by a support table, usually in the form of a conveyer, as is the case in so called top sanding machines, wherein pressure bars or counter pressure rollers arranged adjacent to the machining station form together with the conveyer table the necessary guide means for the workpiece.

If the workpieces are to move through their feeding channel of the apparatus without trouble, the guide means or at least a portion of the guide means must be adjusted for variations in the dimensions of the workpieces, especially with regard to workpiece thickness in order to provide the pressure with which the workpiece must be forced against the tool such as a wide width sanding belt. Adjustments by known manual or servomotor means involve moving either the guide or working components perpendicularly relative to the workpiece. Such prior art adjustment means, however, require that an operator first ascertains the thickness of the workpiece, for example, by means of a caliper rule or a dial gauge before he can go ahead with the adjustment. This procedure is not only time consuming but also subject to measuring errors. Thus, the rate of rejections is particularly high when the workpiece dimensions change frequently.

OBJECTS OF THE INVENTION

In view of the above, it is the aim of the invention to achieve the following objects singly or in combination:

to provide an apparatus for automatically determining the dimensions of the workpiece and to control the pressure applied to the workpiece also automatically in response to the dimensions of the workpiece;

to provide an apparatus of the type here described which operates safely and accurately even under difficult working conditions;

to provide an apparatus for automatically varying the height of a feeding channel in response to the thickness of the workpiece passing through said workpiece feeding channel;

to provide means for controlling the speed of channel height adjustment, whereby the adjustment speed is reduced as the workpiece guide means come close to the required position;

to adjust the height of the feeding channel to different values, even for one and the same workpiece thickness in order to vary the pressure applied to the workpiece;

to provide means for preventing additional changes in the position of the workpiece guide means during the passage of the workpiece through the feeding channel once the adjustment for that particular workpiece has been made; and to keep the channel forming workpiece guide means in the adjusted position until the entire length of a workpiece has passed through the channel, whereby the channel height adjustment does not respond to thickness variations along the length of one and the same workpiece.

SUMMARY OF THE INVENTION

This invention relates to a workpiece feeding apparatus, especially for workpiece machining equipment comprising a sensor for determining the dimensions of the workpiece. Control means responsive to the sensor operate drive means of an adjustably supported feeding channel forming guide means. The control means comprise, for example, sensor operated cam means and switching means associated with the guide means and operated by the cam means. The switching means and cam means cooperate to control a servomotor driving the guide means in accordance with the dimensions, especially the thickness of the workpiece as determined by the sensor. The sensor comprises one or more sensing members contacting the workpieces whereby the movement of the sensing members is proportional to the dimensions of the workpiece such as its thickness. By adjustably mounting at least one of the control means, for example the switching means, on the workpiece guide means it is possible to vary the pressure of the guide means on the workpiece, even though, the dimension remains the same. After adjustment, said one control means is locked or secured in the newly adjusted position, for example by a set screw or by a selflocking adjusting mechanism. The control means preferably comprise means for switching the servomotor to slower speeds so that the guide means may inch up to a required position.

BRIEF FIGURE DESCRIPTION

In order that the invention may be clearly understood, it will now be described, by way of example, with reference to the accompanying drawings, wherein.

DETAILED DESCRIPTION OF EXAMPLE EMBODIMENTS

Figure 1:
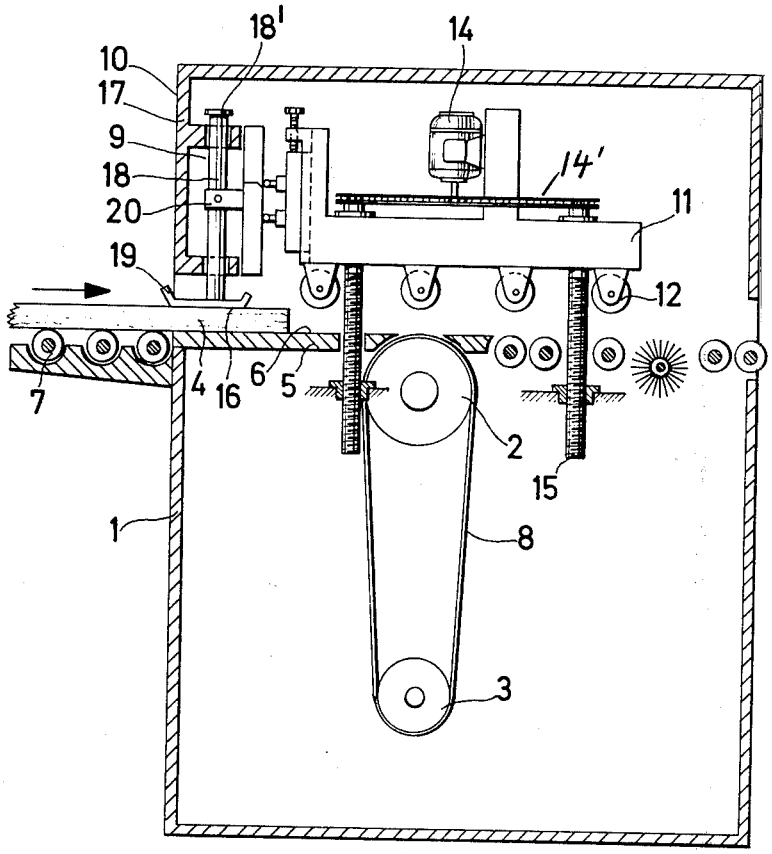
FIG. 1 shows an elevation view, partially in section, of a bottom sanding, wide belt sander incorporating this invention.

FIG. 1 illustrates a bottom-sanding, wide belt sander having a base or housing 1 in which a contact roller 2 and a drive roller 3, surrounded by a sanding belt 8, are mounted for rotation. The drive roller 3 is driven by means not shown. A table 5 supports a workpiece 4 so that the underside of the workpiece contacts the sanding belt 8. Conveyer rollers 7 project slightly above the surface 6 of the support table 5.

A workpiece guide means 11 for applying pressure to a workpiece 4 to press it against the sanding belt 8 is mounted for vertical movement in an upper frame 10. Rollers 12 are mounted to the underside of the guide means 11 for engaging a workpiece 4. The guide means 11 can be either raised or lowered, for example by means of screws 15, driven by a servomotor 14 through chain drives 14'.

Figure 2:
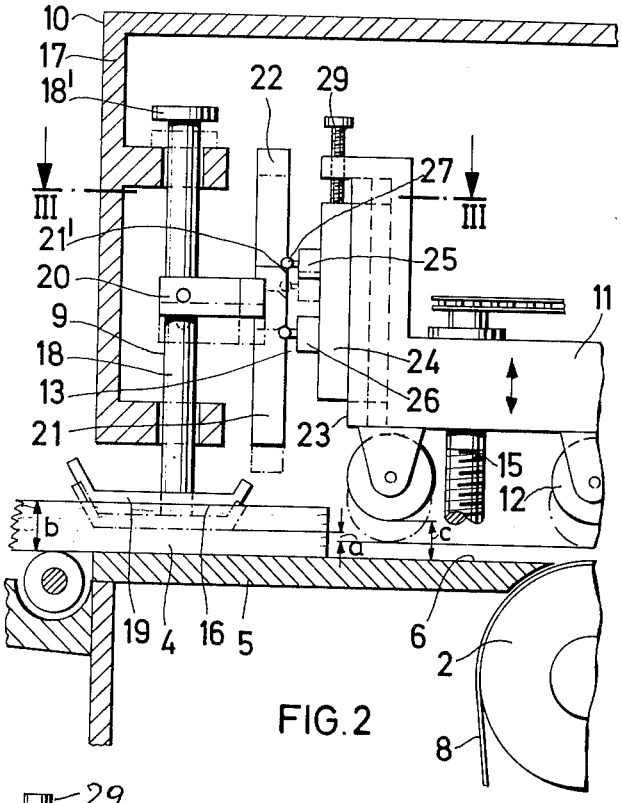
FIG. 2 shows the sensor, the control means and the workpiece guide means of the apparatus of FIG. 1 in greater detail.
Figure 4:
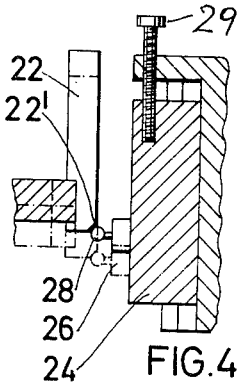
FIG. 4 shows a sectional view along section line IV—IV in FIG. 3.

Sensing means such as a sensor 9 for determining the dimensions of the workpiece 4 by contacting the workpiece is mounted for vertical sliding movement on the front wall 17 of the upper frame 10 in respective aperture lugs. The sensor 9 comprises a vertically moving shaft or rod 18, and a shoe 19 secured to the free end of the rod 18 and capable of being lifted by a workpiece 4. A collar 18' connected to the upper end of the rod 18, provides a means for adjusting the maximum downward movement of the rod 18 and thus the distance between the support surface 6 of the feeding table 5 and shoe 19. A plate or bracket 20, fastened to the rod 18 and if desired adjustable in its position along the rod 18, for example by a set screw, supports control means in the form of oppositely extending contact or switch actuating arms 21 and 22 best seen in FIGS. 2, 3, and 4. The lower end of arm 22 is bevelled at 22' as shown in FIG. 4. The upper end of arm 21 is bevelled at 21' as shown in FIG. 2.

The control means further comprise switching means 25 and 26 and respective switch actuator means 27 and 28 arranged for cooperation with said arms 21 and 22. A plate 24 is slidably mounted in a side 23 of the tool guide means 11. By manually adjusting turning screw 29, the plate 24 and thus the position of the switch actuator or cam follower means 27 and 28 may be moved vertically up and down. The arms 21 and 22 as well as the switching means 25, 26 and switch actuator means may be considered to form a first control unit. The adjustment screw may be self-locking to hold the plate 24 in its adjusted position.

Figure 3:
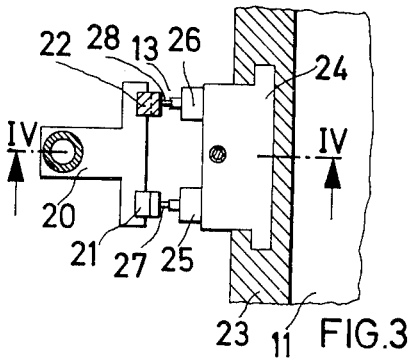
FIG. 3 shows a sectional view along section line III—III in FIG. 2.
Figure 8:
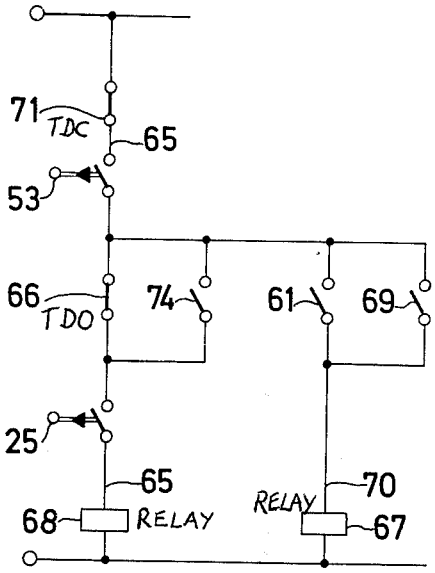
FIG. 8 shows a partial electrical circuit diagram, especially useful for the embodiment shown in FIG. 7.

The operation of this apparatus will now be described with reference to FIGS. 2 to 4. Before a workpiece 4 reaches the sensor 9, the elements which are movable up and down are in their lowermost position as shown by dash-dotted lines in FIG. 2. In this lowermost position the switch actuators or cam followers 27 and 28 are positioned opposite the respective bevel edges 21' and 22', whereby the switches 25 and 26 are inoperative, (open) as seen in FIG. 8. When switches 25 and 26 are inoperative, servomotor 14 is not energized. Hence the guide means 11 is halted at its lowest position. In this condition, the plane defined by the presser guide rollers 12 of the guide means 11 is somewhat lower by a distance *a*, than the contact surface 16 of the sensing shoe 19.

If now a workpiece 4 is moved manually toward the sanding belt 8, the shoe 19 is lifted a distance *b* corresponding to the thickness of a workpiece. The lifting shoe 9 moves rod 18 in an upward direction by the same distance *b*. Since arms 21 and 22 are connected to shaft 18 through member 20, these arms move correspondingly vertically upward. During this upward movement of the sensor 9 and the arms 21 and 22 only cam follower 27 is actuated by arm 21 as arm 22 is positioned to move away from cam 28 during upward movement. Actuation of cam follower 27 by arm 21 places switch 25 in an operative position thereby energizing servomotor 14, whereby the guide means 11 are adjusted upwardly. During this upward movement of the guide means 11, the switch 25 also moves upwardly until cam follower 27 reaches a position where it is no longer contacted by arm 21, but where it is opposite bevelled edge 21', whereby switch 25 will return to its inoperative position. Thus, servomotor 14 is again deenergized and in turn will stop so that the rollers 12 extend again a distance *a* below surface 16 of shoe 19. Accordingly, a distance *c* which is less than the width *b* of the workpiece, exists between the rollers 12 and the support surface 6 of the table 5. Hence, the revolving, elastic rollers 12 can press the workpiece 4 with a predetermined contact force to push the workpiece over the sanding belt 8, whereby the latter is sanding the underside of workpiece 4.

After workpiece 4 has entirely passed the sensor 9, shoe 19 drops either by its own weight or by spring action, and this in turn moves shaft 18 downwardly. Since arms 21 and 22 are fastened to shaft 18 through member 20, they also move downwardly. During this downward movement only cam follower 28 is actuated by arm 22 since arm 21 is positioned to move away from cam follower 27 during these downward movements. Actuation of cam follower 28 by arm 22 closes switch 26 thereby energizing servomotor 14 to drive guide means 11 downwardly. This downward movement continues until the cam follower 28 drops into bevel 22' whereby the motor 14 is switched off. At this point all the elements again take up their dash-dotted lowest position.

During operation of this machine, it is normally to be expected that workpieces having different thicknesses *b* will be fed through the machine. However, it is an advantage of the invention that the guide means 11 will be moved to the correct position for any normal workpiece thickness *b*.

For practical reasons, it is useful to vary the contact force of the pressure rollers 12 on the workpiece 4. This may easily be done by turning the adjusting screw 29. Thus, if plate 24 is shifted upwardly, cam follower 28 is contacted by arm 22 thereby closing switch 26 and energizing servomotor 14, whereby guide means 11 and therefore rollers 12 are moved downwardly until cam 28 reaches a position wherein it no longer contacts the arm 22. This results in increasing the spacing *a* and thus the pressure of the rollers 12 on the workpiece 4. When plate 24 is shifted downwardly by turning adjusting screw 29, cam follower 27 is contacted by arm 21 thereby placing switch 25 in an operating position and energizing servomotor 14, whereby the guide means 11 and therefore rollers 12 are moved upwardly until cam follower 27 reaches a position wherein it no longer contacts arm 21. This decreases the pressure of the guide rollers 12 on the workpiece 4.

For achieving greater accuracy in adjusting the pressure guide means 11, further cam follower and switching means may be used to operate the servomotor in an inching or creep feeding manner just prior to the time when the guide means 11 reach the final working position. Further accuracy may be accomplished by utilizing a so called brake motor as the servomotor 14.

Figure 5:
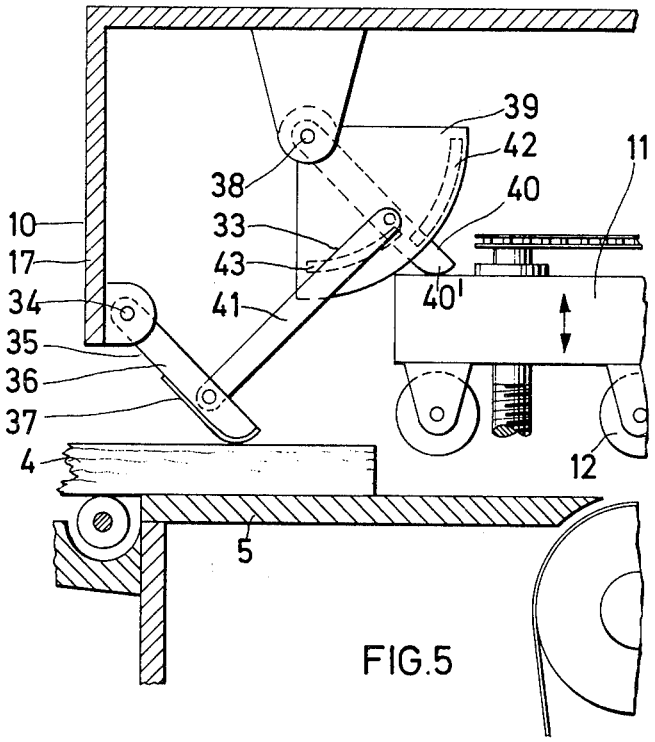
FIG. 5 shows a view similar to FIG. 2 but illustrating another embodiment of the sensor and control means according to the invention.
Figure 6:
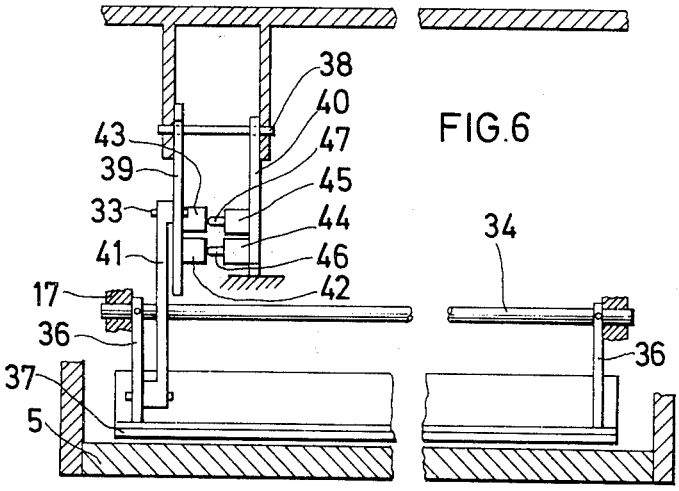
FIG. 6 shows a rear view of the embodiment shown in FIG. 5.

FIGS. 5 and 6 illustrate another embodiment of the invention employing a sensing means 35 comprising at least one, preferably two levers 36 journaled on an axle 34, which in turn is mounted on the front wall 17 of the upper frame or housing 10. The free ends of the levers 36 are connected to each other by a sensing plate 37 having a length corresponding substantially to the width of the support table 5. In addition to its own weight a suitable spring means may force the plate 37 against a workpiece 4. Another axle 38 is mounted in the frame 10. A control segment 39 and a lever 40 are journaled or pivoted to said axle 38 with a spacing therebetween and independent of each other. The free end 40' of the lever 40 rides on the guide means 11 so that the vertical movement of guide means 11 is translated by the movement of lever 40 into a circular motion. The control segment 39 and either one of levers 36 are pivotally connected to each other by bar 41. The arrangement comprising the lever 36, the bar 41, and the control segment 39 forms substantially a parallelogram, one side of which is an imaginary line extending from the contact point between the plate 37 and the workpiece 4 to the contact point between the lever 40 and the guide means 11.

The control segment 39 carries on its side facing the lever 40 curved cam sections 42 and 43, radially offset from each other. The control lever 40 has mounted on its side facing segment 39 switches 44 and 45 with cam followers 46 and 47 respectively. The cam followers 46 and 47 are positioned to cooperate with the cam sections 42 and 43 respectively.

The operation of this second embodiment is analogous to that of the first embodiment shown in FIGS. 1 to 4. Before a workpiece 4 reaches the sensing means 35, the lever 36 will extend substantially vertically. The lever 40 will be positioned so that the cam followers 46 and 47 will not contact their respective cam sections 42 and 43. Hence, the switches 44 and 45 will be in their inoperative positions and the servomotor 14 will be de-energized whereby the guide means 11 will be at its lowest position.

If now a workpiece 4 is moved toward the sanding belt 8, the sensing plate 37 and therefore lever 36 are moved along an upward arc. Since segment 39 is connected to lever 36 by bar 41, it likewise will swing upwards along a similar arc. During this upward movement of the lever 36, the lever 40 is stationary. The respective relative movement causes cam follower 47 to ride on cam section 43 whereby the switch 45 is actuated to energize the servomotor 14, which in turn drives guide means 11 upwardly. Upward movement of the guide means 11 results in swinging lever 40 upwardly traversing an arc similar to that of segment 39. Therefore, cam follower 47 moving along section 43 will return to its initial position substantially along the bisecting axis of the segment 39. At this position switch 45 is opened and servomotor 14 is thereby stopped, halting further movement of guide means 11.

After the workpiece 4 has entirely cleared the sensing means 35, the lever 36 and the segment 39 will move along a descending arc. Since lever 40 remains stationary, there is relative movement and thus contact between cam follower 46 and cam section 42 which closes switch 44 thereby energizing servomotor 14, which in turn drive the guide means 11 in a descending direction. This downward movement of the guide means 11 swings lever 40 along a descending arc similar to that traversed by segment 39. Therefore, the cam follower 46 moving along the section 42 will return to its initial position at the bisecting axis of the segment 39. At this position switch 44 is opened thereby de-energizing servomotor 14 and stopping the guide means.

Figure 7:
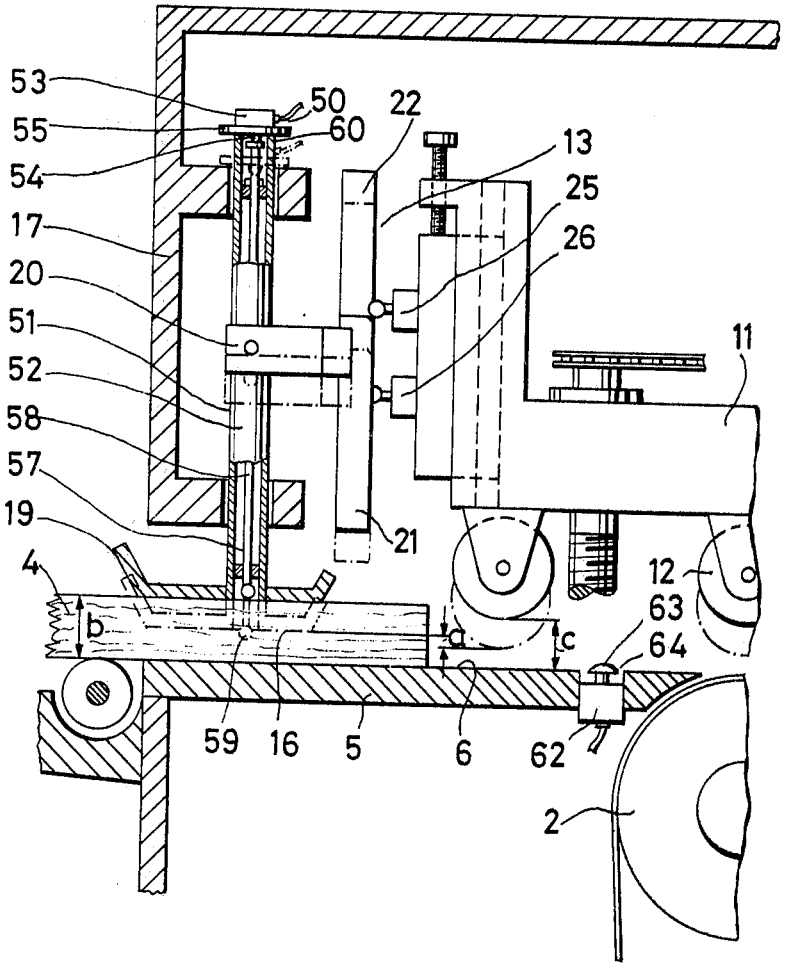
FIG. 7 illustrates an elevational view of yet another embodiment of the sensor and control means according to the invention.

FIG. 7 illustrates a third embodiment employing additional sensing and control means. A first sensing means 51 comprises a hollow tube 52 mounted for vertical movement, a shoe 19 connected to the lower end of tube 52, and a collar 55 secured to the upper end of the tube 52 which operates substantially as described in the preceding paragraphs relating to FIGS. 1 to 4. The collar 55 just as collar 18' determines, as described, the spacing between the contact or sensing surface 16 of the shoe 19 and the top surface 6 of the feeding table 5.

A second sensing means 57 is movably mounted within the hollow tube 52 and comprises a sensing rod 58, and a ball or roller 59 pivotally mounted to the lower end of rod 58. A collar 60 is mounted to the upper end of the rod 58. The collar 60 may rest on a bushing fixed within tube 52 through which rod 58 slides. When the collar 60 rests on said bushing, the ball or roller 59 is in its lowest position thereby projecting slightly below the shoe 19. Here again, a predetermined distance between the lower tip of the sensing rod 58 and the surface 6 is established when the collar 60 rests on the bushing tube 52. A second control switch 53, actuated by the rod 58, is mounted on the collar 55. The rod 58 and the switch 53 form the switching control means 50. The other switching control means are the same as in FIGS. 1 to 4.

A third control switch 62 is mounted in the support table 5 in front of the contact roller 2 at a distance from the sensing roller 59 which is less than the length of the shortest workpiece to be machined. The switch 62 is actuated by a cam 63 projecting above support surface 6 so as to be contacted by a workpiece 4. The switch 62 and the cam 63 form a further switching control means 64.

The operation of the third embodiment of the invention will now be described with reference to FIGS. 7 to 9. Before workpiece 4 reaches the first sensing means 51, the shoe 19, roller 59 and rollers 12 are in their lowest position illustrated by dash-dotted lines in FIG. 7.

Figure 9:
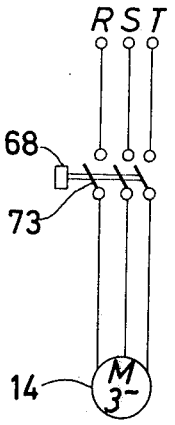
FIG. 9 shows an electrical circuit diagram of the drive means employed especially in FIG. 7.

The electrical diagram of FIG. 9 is applicable to FIGS. 1 to 7 showing the servomotor 14 can be energized by closing the normally open contacts of contactor or switching relay 68, whereby this relay 68 is controlled by switches 25 and 26 arranged in respective conventional relay control circuit means.

FIG. 8 which relates to the embodiment of FIG. 7 illustrates a partial circuit diagram for the present control means. One terminal of the relay 68 is directly connected to a power supply source (not shown). The other terminal of the relay 68 is connected to the second terminal of the power supply through a relay control circuit 65 including a series arrangement of switches and contacts; namely the normally closed contact 71 of a relay, not shown, but actuated by the third control switch 62, the normally open second control switch 53, the normally closed contact 66 of a switching relay 67 which is initially energized by the relay 68 and the normally open first control switch 25, previously described. The normally closed contact 66 is connected in parallel to a normally open contact 74 of the relay 68. A further normally open contact 61 of relay 68 closes an energizing circuit 70 for the relay 67. With the closing of the control switches 25 and 53 an upward movement of the guide means 11 is initiated since the relay 68 is energized thereby closing the contacts 61 and 74. A downward movement of the guide means 11 involves the same functions except it is initiated by the closing of switch 26.

As a workpiece 4 moves toward the sanding belt 8, shoe 19 is lifted, and as previously discussed, thereby lifting the hollow shaft 52 of the first sensing means 51. Since arms 21 and 22 are coupled to shaft 52, switch 25 is closed. However, the servomotor 14 is not energized until workpiece 4 contacts the sensing roller 59 thereby closing the switch 53 through rod 57. When this occurs, the relay 68 is energized and closes its contacts 73 to energize the servomotor 14 and to drive the guide means 11 upwardly. As mentioned, energizing of the relay 68 also closes the contact 74 to bypass the contact 66, and to close the contact 61 thereby energizing the relay 67. The energizing of the relay 67 has no effect on relay 68 even though the contact 66 is opened due to the holding circuit closed by the contact 74. Hence, motor 14 keeps running. Similarly, once relay 67 is energized, operating relay 68 will have no effect on relay 67 because its contact 69 has established a holding circuit for relay 67.

When the guide means 11 have been moved upwardly to the required position as previously described, switch 25 is opened thereby de-energizing relay 68 and hence the servomotor 14, whereby the guide means 11 stop. However, relay 67 will be kept energized during the machining through its holding contact 69 until the second switch 53 is opened in response to the workpiece passing the roller 59 at the end of rod 57. With that relay 67 is de-energized and returns to its initial condition with the closing of the contact 66 and the opening of the contact 69.

Thus the return of the first sensing means 51 to its lowest position can not influence the relay 68 and restart the motor 14, because switch 25 and 53 as well as contact 69 are opened.

Not until a further workpiece 4 is moved toward the sanding belt 8 and lifts the shoe 19 and the sensing roller 59 a restarting of the motor 14 and adjusting of the guide means 11 to the workpiece dimension will be possible. On the other hand, the contact 66 is held open during the machining and the motor 14 cannot be restarted during the machining. This is an important feature of the invention because the surface of any workpiece may comprise waves or even steps in the direction of feeding movement, which waves or steps cannot affect the machining operation as long as contact 66 is held open and contact 74 is open. The control circuit is returned to its initial condition with the opening of the switch 53 which de-energizes relay 67 and again closes contact 66.

The third control switch 62 assures that the guide means 11 is held at the proper position for each workpiece until the entire length of a workpiece has passed through the feeding channel. When workpiece 4 contacts the cam 63, the switch 62 is operated to open the contact 71. Hence, relay 68 cannot be energized until workpiece 4 has entirely cleared cam 63, at which time switch 62 is released, resulting in the closing of contact 71.

To allow the cycle initiated by a new workpiece to start only after the preceding workpiece has completely cleared the feeding channel it is preferable to provide a timing device with adjustable delays for the closing of the contact 71 after actuating the switch 62. Thus, the contact 71 may be, for example, a time delay closing (TDC) contact. Alternately, another switch may be employed behind the last presser roller 12 to close contact 71. This result can also be implemented if the relay for actuating the contact 71 is energized by the switch 53 after a time delay determined by the feed advance speed. Incidentally, the contact 66 should preferably be a time delay opening contact (TDO).

Figure 10:
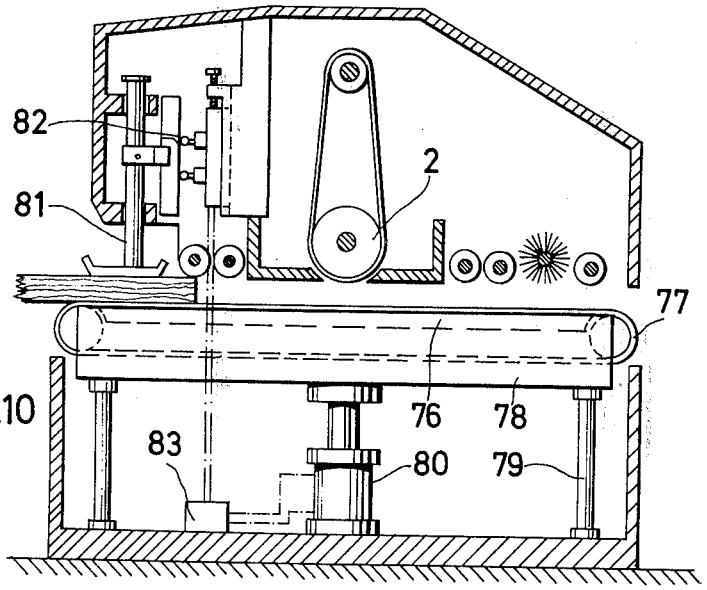
FIG. 10 shows an elevational view of a top sanding machine of the wide belt type according to the invention.

FIG. 10 shows a top sanding wide belt sander employing a support table 76 having a feed belt 77. The table frame 78 is supported on adjustable mounting columns 79 and movable by hydraulically driven piston cylinder means 80. A sensor 81 having control switching means 82 similar to those described is used. The control means control the piston cylinder means 80 through a control valve 83.

In the above described embodiments mechanical sensing means have been used primarily because such devices work satisfactorily in dust laden environments. However, the invention may also be embodied by using other sensing means such as optical, pneumatic, hydraulic, electrical or acoustical sensors for controlling the servomotor 14. Likewise, rollers 12 and/or the contact roller 2 may be replaced by a sliding shoe arrangement. The invention is also suitable for feeding sheet materials to a working station. Furthermore, the guide means 11 could be modified to carry the working tools thereby controlling the contact between the tools and the workpiece.

Although the invention has been described with reference to specific example embodiments, it is to be understood, that it is intended to cover all modifications and equivalents within the scope of the appended claims.

We claim:

1. An apparatus for feeding a workpiece through a machine comprising conveyor means movably supporting a workpiece, sensing means arranged proximate to said conveyor means for contacting said workpiece to determine at least one dimension of said workpiece, first control means coupled to said sensing means and responsive to said sensing means, workpiece guiding means arranged in said machine at a level above said conveyor means and adjacent to said sensing means, said workpiece guiding means comprising drive means for moving said workpiece guiding means relative to said workpiece, and second control means coupled to said workpiece guiding means for cooperation with said first control means for controlling said drive means and thus the movement of said workpiece guiding means in accordance with the dimension of said workpiece as determined by said sensing means.

2. In a workpiece feeding apparatus, especially for machining equipment including adjustable workpiece feeding means, drive means operatively connected to said workpiece feeding means, as well as workpiece dimension sensing means and control means responsive to said workpiece dimension sensing means, said control means being operatively connected to said drive means to adjust said workpiece feeding means to a workpiece dimension representing position in response to said workpiece dimension sensing means, the improvement wherein said workpiece feeding means comprise adjustable workpiece guide means, said control means comprising first switch means operatively arranged to respond to said workpiece dimension sensing means when the latter move in a given direction, and second switch means operatively arranged to respond to said workpiece dimension sensing means when the latter move opposite to said given direction, said first and second switch means being operatively connected to said drive means for energizing the drive means to move said adjustable workpiece guide means directly into and out of its work position whereby direction reversal of the movement of the workpiece guide means on its way into the working position is avoided.

3. The apparatus according to claim 2, wherein said first switch means comprise first switch actuator means and a first switch member, said second switch means comprising second switch actuator means and a second switch member, said apparatus further comprising support means securing said first and second switch members to said adjustable workpiece guide means, said first and second switch actuating means being secured to said workpiece dimension sensing means for respectively actuating said switch members in response to movement of said workpiece dimension sensing means.

4. The apparatus according to claim 3, wherein said first and second switch actuator means comprise respective actuating cam elements arranged so that one cam element is effective when the workpiece dimension sensing means moves in one direction while the other cam element is effective when the workpiece dimension sensing means moves in the opposite direction, whereby said drive means for adjusting the position of said workpiece guide means is controlled by said cam elements to move the workpiece guide means directly into and out of the working position.

5. The apparatus according to calim 2, wherein said workpiece feeding means further include a feeding table, said workpiece dimension sensing means comprising sensing lever means, means journaling said sensing lever means in said apparatus in a position parallel to said feeding table, said first and second switch means of said control means comprising first and second switch members connected to energize and de-energize said drive means and first and second switch actuator means operatively associated with said sensing lever means for actuating said first and second switch means in response to tilting of said sensing lever means about said journaling means.

6. The apparatus according to claim 5, wherein said control means comprise a control segment carrying said first and second switch actuator means, first means pivoting said control segment in said apparatus, connecting bar means pivotally linking said sensing lever means and said control segment, said control means further comprising a support bar carrying said first and second switch means, second means pivoting one end of said support bar in said apparatus, said support bar having a free end riding on said workpiece guide means, said support bar being arranged to locate said switching means for cooperation with said control segment.

7. The apparatus according to claim 2, wherein said first and second switch means of said control means comprise separate support means and means for adjusting the position of at least one switch means relative to its respective support means, whereby the pressure of said adjustable workpiece guide means on said workpiece may be varied.

8. The apparatus according to claim 2, wherein said workpiece dimension sensing means comprise first sensing means and second sensing means, said control means comprising control circuit means for said drive means, said first and second switch means including first, second and third switch members, arranged in said control circuit means for energizing and de-energizing said drive means, said first and second switch means of said control means further comprising first, and second switch actuator means arranged to control said first and second switch members in response to said first sensing means, and third switch actuator means arranged to control said third switch member in response to said second sensing means.

9. The apparatus according to claim 8, wherein said first and third switch members comprise respective contacts operated through the first and second sensing means, said contacts being arranged in series with each other in said control circuit means.

10. The apparatus according to claim 8, wherein said first sensing means comprise a hollow tube and means slidably mounting said hollow tube in said apparatus so that one of its ends contacts a workpiece, said second sensing means comprising a sensing rod and means slidably mounting said sensing rod inside said hollow tube, said sensing rod having a lower free end protruding from said hollow tube into contact with said workpiece, said first switch actuator means being secured to said hollow tube, said first switch member comprising first contact means carried by said workpiece guide means for actuation by said first switch actuator means, said second switch member comprising second contact means secured to the workpiece guide means for actuation by said second switch actuator means, said third switch member comprising third contact means secured to the hollow tube at its top for actuation by said sensing rod, said first, second and third contact means being arranged in series with each other.

11. The apparatus according to claim 2, wherein said control means comprise a control circuit for said drive means, said first and second switch means comprising respective switch members arranged in said control circuit for actuating said drive means, said control means further comprising first and second switch actuator means responsive to said sensing means and arranged for actuating said first and second switch members, further switch means connected in series in said control circuit between said first and second switch members, said further switch means comprising means responsive to said first switch actuator means for operating said second switch means into a circuit interrupting state, and further responsive to said second switch actuator means for actuating said second switch means back into a circuit closing rest position.

12. The apparatus according to claim 11, further comprising third switch means in said control circuit responsive to said second switch actuator means, said third switch means comprising time delay means for delaying the control action of the second switch actuator means.

13. The apparatus according to claim 11, wherein said control means comprise third switch control means located adjacent to said tool means and operable by a workpiece, and third switch means arranged in said control circuit and responsive to said third switch control means for actuating said third switch means into a circuit interrupting state.

14. The aparatus according to claim 13, wherein said third switch means comprise time delay means for delaying the control action of the third switch control means.

* * * * *